United States Patent [19]

Petersen

[11] Patent Number: 4,893,803

[45] Date of Patent: Jan. 16, 1990

[54] METHOD OF AND DEVICE FOR FOLDING A SHEET

[75] Inventor: Heino Petersen, Wabern, Switzerland

[73] Assignee: Eltex-Elektrostatik Gesellschaft mbH, Weil am Rhein, Fed. Rep. of Germany

[21] Appl. No.: 3,735

[22] Filed: Jan. 16, 1987

[51] Int. Cl.[4] ..... B42C 1/04

[52] U.S. Cl. ..... 270/47; 270/20.1

[58] Field of Search ..... 270/20.1, 21.1, 47, 270/48, 49, 50, 51, 60; 493/424–426, 428, 429, 432, 359, 360; 271/193, 282

[56] References Cited

U.S. PATENT DOCUMENTS

| | | | |
|---|---|---|---|
| 3,323,794 | 6/1967 | Brandt | 271/193 |
| 3,346,253 | 10/1967 | Paschke | 271/193 |
| 3,351,340 | 11/1967 | Levine | 271/193 |
| 4,494,949 | 1/1985 | Baley | 493/432 |
| 4,666,139 | 5/1987 | Filewich | 493/432 |

FOREIGN PATENT DOCUMENTS

| | | | |
|---|---|---|---|
| 2142902 | 3/1973 | Fed. Rep. of Germany | 270/47 |
| 2634108 | 2/1978 | Fed. Rep. of Germany | 493/428 |
| 364709 | 1/1932 | United Kingdom | 271/172 |
| 2067523A | 7/1981 | United Kingdom | 271/193 |

*Primary Examiner*—Randall L. Green
*Assistant Examiner*—Therese M. Newholm
*Attorney, Agent, or Firm*—Max Fogiel

[57] ABSTRACT

A method of folding a sheet, cut from at least one advancing web of material electrostatically bonded at least on one side and preferably consisting of paper or of a composite manufactured therefrom, transferred to a collecting cylinder, picked up in the vicinity of its midline by a folding cylinder that rests against the collecting cylinder in a nip along the midline of the sheet, and drawn completely over the folding cylinder while both halves of the sheet are folded together along the midline as the rotation continues, whereby the cylinders rotate in opposite directions and the web is charged at least outside the cylinders if necessary. An electrostatic field exerts a force of attraction in the nip (which is upstream in the direction that the two cylinders rotate in) on the top of the sheet (which is pulled off in a direction opposite the one that the collecting cylinder rotates in) toward a guide and the sheet is accordingly attracted and transferred to the folding cylinder.

14 Claims, 1 Drawing Sheet

METHOD OF AND DEVICE FOR FOLDING A SHEET

The invention concerns a method of and a device for folding a sheet cut from an advancing web of material, transferred to a collecting cylinder, picked up in the vicinity of its midline by a folding cylinder that rests against the collecting cylinder in a nip along the midline of the sheet, and drawn completely over the folding cylinder while both halves of the sheet are folded together along the midline as the rotation continues, whereby the cylinders rotate in opposite directions and the web is charged at least outside the cylinders if necessary.

This method can be employed in rotogravure, flexographic, letterpress, or offset printing. Folding devices that operate on this principle entail the risk, especially at high speeds, that what is called "lashing" in the vicinity of the collecting and folding-knife cylinder, which will be briefly termed the "collecting cylinder" hereinafter, will produce dog-ears or tears at the rear edge of the copy, specifically at both the bottom and the top of the sheet, even during double folding.

The problem is counteracted in rotogravure by securing the entering webs or strips together electrostatically, a process called "strip bonding." This electrostatic interlocking increases the stability of the web, decreasing the risk of dog-earing.

Strip bonding, however, is possible only to a limited extent in rotary flexographic, letterpress, and especially offset printing.

The object of the invention is to improve a method and device of the aforesaid genus in order to avoid lashing and hence increase throughput without dog-earing.

This object is attained in a surprisingly easy way in accordance with the invention by the objects of the method claim and of the device claim.

Thus, the top of the sheet is drawn toward a guide by electrostatic force and channeled and transferred by the guide to the folding cylinder without impact or flapping, allowing considerably higher speeds. Alternatively or by way of support of the aforesaid effect, once the bottom of the sheet has been transferred to the folding cylinder, its rear can rest against a segment of the surface of the cylinder that is electrostatically recharged every time the cylinder rotates, causing its end as well to rest tight against the folding cylinder until it comes into contact with the top of the sheet, at which point the folding process is complete.

Practical embodiments and developments of the invention are characterized in the subsidiary claims.

Figure 1:
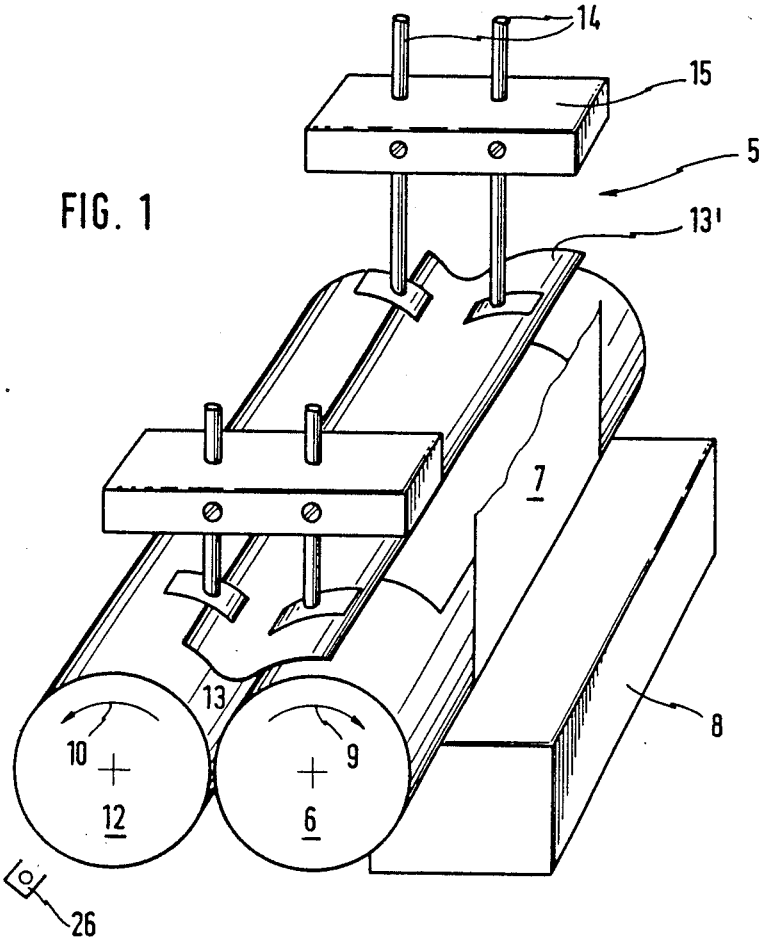
Figure 2:
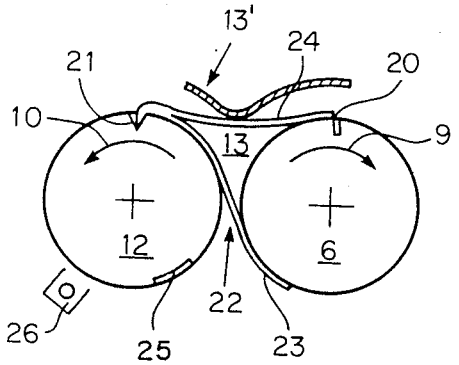
Figure 3:
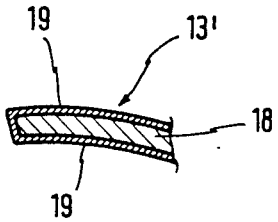

A preferred embodiment of the invention will now be specified with reference to the drawing, wherein FIG. 1 is a perspective view of a device in accordance with the invention for carrying out the method in accordance with the invention, FIG. 2 is a schematic front view of the device illustrated in FIG. 1, and FIG. 3 is a cross-section through the guide illustrated in FIGS. 1 and 2.

The folding device, labeled 5 overall in FIG. 1, has a collecting and folding-knife cylinder 6 with a web 7 traveling onto its surface. Web 7 is separated into sheets of a very specific length by an unillustrated guillotine accommodated in a block 8 and secured by points once the downstream briefly termed collecting cylinder has rotated one unit farther in the direction indicated by arrow 9.

A folding cylinder 12 parallels and rests against collecting cylinder 6, rotating in the opposite direction.

A nip 13, upstream in relation to the directions indicated by arrows 9 and 10 and located between cylinders 6 and 12, is covered by a guide, generally labeled 13', and can be raised and lowered in relation to beams 15 by rods 14. The beams can also move back and forth, allowing the position of guide 13' to be precisely established.

Guide 13' is essentially S-shaped in the illustrated embodiment. It has, as will be evident from FIG. 3, a midsection 18 that can be electrostatically charged and an electrically non-conductive section 19 on each side of the midsection. The midsection is connected to a source of electrostatic voltage.

As will be evident from FIG. 2, collecting cylinder 6 is equipped with a projecting folding knife 20 and folding cylinder 12 with a flap 21 that operates in conjunction with the knife. A separated sheet 22 is forced along a line in the vicinity of its middle into flap 21 by folding knife 20 for the purpose of being folded. The the bottom 23 of sheet 22 is advanced toward folding cylinder 12 in the direction indicated by arrow 9 by collecting cylinder 6, whereas the top of the sheet is drawn onto collecting cylinder 6 opposite the direction indicated by arrow 9, which would result in lashing except that the latter is practically eliminated by the positioning of guide 13' and its connection to a source of electrostatic high voltage.

Folding cylinder 12 also has a segment 25 in its surface to secure the rear of the bottom 23 of sheet 22 and consisting of an electrostatically chargeable insulator, which also helps to prevent lashing. An electrode 26 is also positioned upstream of nip 13 in the direction of rotation, electrostatically recharging segment 25 at every rotation.

The guide 13' can have a variety of shapes, and the central section of this guide may be made of sheet metal. The electrically non-conductive section may be in the form of a coating of lacquer.

The outside of the web 7 may have a charging electrode of predetermined polarity. Another electrode 26 of opposite polarity may be provided for the folding cylinder 12 and the guide 13'.

A source of negative high voltage may be connected to the electrode 26 of opposite polarity for the folding cylinder and the guide.

I claim:

1. A method of folding a sheet cut from at least one advancing web of material bonded electrostatically on at least one side, comprising the steps of: transferring said sheet to a collecting cylinder; picking up said sheet in vicinity of a midline of said sheet by a folding cylinder resting against said collecting cylinder in a nip along said midline; drawing said sheet completely over said folding cylinder while folding both halves of the sheet together along said midline during rotation of said cylinders; rotating said cylinders in opposite directions; charging said web at least outside said cylinders if necessary; exerting a force of attraction in said nip by an electrostatic field, said electrostatic field producing a nonadhesive effect to prevent formation of corners during folding of said sheet, said nip being upstream with respect to the direction of rotation of said cylinders, said force being exerted on top of said sheet for pulling the sheet off in a direction opposite the direction of rotation of said collecting cylinder and moving said sheet toward a guide, so that the sheet is attracted and transferred to said folding cylinder, pulling off a part of the folded sheet in a direction opposite to the direction of rotation of the folding cylinder producing an adhesive effect.

2. A method a defined in claim 1, including the step of recharging said folding cylinder electrostatically upon each rotation of said folding cylinder; resting the rear of said sheet against a segment of the surface of said folding cylinder once the bottom of said sheet has been transferred to said folding cylinder; bringing the end of said sheet to rest also tightly against said folding cylinder until said sheet end comes into contact with the top of said sheet whereby said sheet is completely folded.

3. An arrangement for folding a sheet cut from at least once advancing web of material bonded electrostatically on at least one side, comprising: a collecting cylinder and means for transferring said sheet to said collecting cylinder; a folding cylinder for picking up said sheet in vicinity of a midline of said sheet, said folding cylinder resting against said collecting cylinder in a nip along said midline; means for drawing said sheet completely over said folding cylinder while folding both halves of the sheet together along said midline during rotation of said cylinders, said cylinders rotating in opposite directions: means for charging said web at least outside said cylinders if necessary; guide means positioned in said nip located upstream with respect to the direction of rotation of said two cylinders; said guide means having a central section chargeable electrostatically without an adhesive effect to prevent formation of corners during folding of the sheet; and guide means having an electrically non-conductive section on each side of said central section and facing said nip, pulling off a part of the folded sheet in a direction opposite to the direction of rotation of the folding cylinder producing an adhesive effect.

4. An arrangement as defined in claim 3, wherein said guide means can have a variety of shapes.

5. An arrangement as defined in claim 3, wherein said guide means is at least partly curved and covers at least partly said nip.

6. An arrangement as defined in claim 3, wherein said guide means is S-shaped.

7. An arrangement as defined in claim 3, wherein said guide means is movable toward said nip.

8. An arrangement as defined in claim 3, wherein said central section of said guide means comprises a sheet of metal, said electrically non-conductive section comprising a coating of lacquer.

9. An arrangement as defined in claim 8, including a source of high voltage connected to said central section of said guide means.

10. An arrangement as defined in claim 3, wherein said folding cylinder has a surface with a segment therein to secure the rear of the bottom of said sheet, said segment comprising an electrostatically chargeable insulator.

11. An arrangement as defined in claim 3, wherein the outside of said web comprises a charging electrode of predetermined polarity, and another electrode of opposite polarity for said folding cylinder and said guide means.

12. An arrangement as defined in claim 11, including a source of negative high voltage connected to said electrode of opposite polarity for said folding cylinder and said guide means.

13. An arrangement as defined in claim 11, including a source of positive high voltage connected to said electrode of opposite polarity for said folding cylinder and said guide means.

14. An arrangement for folding a sheet cut from at least one advancing web of material bonded electrostatically on at least one side, comprising: a collecting cylinder and means for transferring said sheet to said collecting cylinder; a folding cylinder for picking up said sheet in vicinity of a midline of said sheet, said folding cylinder resting against said collecting cylinder in a nip along said midline; means for drawing said sheet completely over said folding cylinder while folding both halves of the sheet together along said midline during rotation of said cylinders, said cylinders rotating in opposite directions; means for charging said web at least outside said cylinders if necessary; guide means positioned in said nip located upstream with respect to the direction of rotation of said two cylinders; said guide means having a central section chargeable electrostatically without an adhesive effect to prevent formation of corners during folding of the sheet: and guide means having an electrically non-conductive section on each side of said central section and facing said nip. pulling off a part of the folded sheet in a direction opposite to the direction of rotation of the folding cylinder producing an adhesive effect; said guide means being at least partly curved and covering at least partly said nip; said guide means can have a variety of shapes; said guide means being S-shaped; said guide means being movable toward said nip; said central section of said guide means comprising a sheet of metal, said electrically non-conductive section comprising a coating of lacquer; a source of high voltage connected to said central section of said guide means; said folding cylinder having a surface with a segment therein to secure the rear of the bottom of said sheet, said segment comprising an electrostatically chargeable insulator; said web having an outside comprising a charging electrode of predetermined polarity, and another electrode of opposite polarity for said folding cylinder and said guide means; a source of negative high voltage connected to said electrode of opposite polarity for said folding cylinder and said guide means.

* * * * *